US006460339B2

(12) United States Patent
Nishida et al.

(10) Patent No.: US 6,460,339 B2
(45) Date of Patent: Oct. 8, 2002

(54) GAS TURBINE FUEL INJECTOR WITH UNEQUAL FUEL DISTRIBUTION

(75) Inventors: Koichi Nishida; Katsunori Tanaka; Shigemi Mandai; Yutaka Kawata; Masataka Ohta, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/828,138

(22) Filed: Apr. 9, 2001

(65) Prior Publication Data

US 2001/0042375 A1 Nov. 22, 2001

(30) Foreign Application Priority Data

May 19, 2000 (JP) ..... 2000-147241

(51) Int. Cl.[7] ..... F02G 3/00
(52) U.S. Cl. ..... 60/737
(58) Field of Search ..... 60/737, 740, 742

(56) References Cited

U.S. PATENT DOCUMENTS 2,982,098 A * 5/1961 Vickery ..... 60/39.71
5,551,228 A 9/1996 Mick et al.
5,901,549 A 5/1999 Mandai et al.
6,082,111 A * 7/2000 Stokes ..... 60/737

FOREIGN PATENT DOCUMENTS

EP 0 935 095 8/1999

* cited by examiner

*Primary Examiner*—Ehud Gartenberg
(74) *Attorney, Agent, or Firm*—Wenderoth, Lind & Ponack, L.L.P.

(57) ABSTRACT

A gas turbine combustor improves the fuel distribution from a main fuel nozzle, suppressing fluctuations of internal pressure and elevation of inner tube metal temperature, and enhancing the combustion stability and durability of the combustor. The gas turbine combustor is a multi-nozzle type premixing combustor with a nozzle outer tube (7) for forming and injecting a premixed gas of main fuel and combustion air divided and disposed in plural sections around a cone (4) for forming a diffusion flame by reaction between pilot fuel and combustion air disposed in a center of a section of a combustor inner tube (1). Nozzle holes (5*a*) of a main fuel nozzle (5) are formed in three positions at equal intervals on the nozzle main body wall, and one of them is disposed at the outer periphery of the combustor inner tube (1) on a diametral line linking between the center of the combustor inner tube (1) and the center of the main fuel nozzle (5), whereby the fuel distribution to the outer periphery is decreased.

3 Claims, 4 Drawing Sheets

GAS TURBINE FUEL INJECTOR WITH UNEQUAL FUEL DISTRIBUTION

BACKGROUND OF THE INVENTION

1. Field of the Invention

The present invention relates to a gas turbine combustor, and more particularly to a multi-nozzle type premixing combustor.

2. Description of the Related Art

Recently, the gas turbine combustor, for example, a steam cooling type combustor capable of realizing low $NO_x$ even in a gas turbine of 1500° C. class, is attracting wide attention. That is, by cooling the combustor wall by steam, the air hitherto used for cooling of the wall can be used for combustion, and the premixed combustion temperature is suppressed to a level of an air-cooled combustor in spite of temperature elevation in the gas turbine, so that low $No_x$ is realized.

As such a steam cooled combustor, a conventional example of a multi-nozzle type premixing combustor as shown in FIG. 5 is known. In this combustor a nozzle outer tube 7 for forming and injecting a premixed gas of main fuel from a main fuel nozzle 5 and combustion air from a main swirler 6 is divided and disposed in plural sections around a cone 4. The cone 4 forms a diffusion flame by reaction between pilot fuel from a pilot fuel nozzle 2 and combustion air from a pilot swirler 3 and being disposed in the center of the section of a combustor inner tube 1.

In the main fuel nozzle 5, as shown in FIG. 4, the fuel is injected from plural nozzle holes 5*a* (about 1.0 mm in diameter) opened in the nozzle main body wall, and is mixed with the air flowing in the nozzle outer tube through the main swirler 6, thereby forming a premixed gas.

In FIG. 4 and FIG. 5, the arrows show the flow of fuel and air.

However, in such conventional multi-nozzle type premixing combustor, as shown in FIG. 3, since the nozzles holes 5*a* of the main fuel nozzle 5 are formed in three positions on the outer periphery of the combustor inner tube 1 and in two positions at the inner side, the fuel distribution to the outer periphery increases. The fuel may bounce on an elliptical extended pipe 7*a* (which is provided for preventing back-fire by raising the gas flow velocity) due to circumferential swirling flow caused by a swirler, and collide against the wall of the combustor inner tube 1 (see arrow in FIG. 3).

As a result, liquid fuel drops may deposit on the wall of the combustor inner tube 1 (see hatching (□) in FIG. 3), and the internal pressure may fluctuate, spoiling combustion stability, or the metal temperature may be raised by self-ignition, thereby breaking the wall of the combustor inner tube 1 (see broken part (T) in FIG. 3).

SUMMARY OF THE INVENTION

The invention is devised in the light of such background, and it is hence an object thereof to present a gas turbine combustor capable of improving fuel distribution from a main fuel nozzle, suppressing internal pressure fluctuation and elevation of inner tube metal temperature, and realizing combustion stability and improvement of the durability of the combustor.

To achieve the object, the gas turbine combustor of the invention is a multi-nozzle type premixing combustor as follows. A nozzle outer tube for forming and injecting a premixed gas of main fuel and combustion air is disposed in plural sections around a cone for forming a diffusion flame by reaction between pilot fuel and combustion air. The cone is disposed in a center of a section of a combustor inner tube. Nozzle holes of a main fuel nozzle for injecting the main fuel are opened and formed more at the inner side than at the outer periphery of the combustor inner tube in the nozzle main body wall, and the fuel distribution to the outer periphery is decreased.

DETAILED DESCRIPTION OF THE PREFERRED EMBODIMENT

A gas turbine combustor of the invention is described below by referring to a preferred embodiment thereof taken in conjunction with the accompanying drawings.

Figure 1:
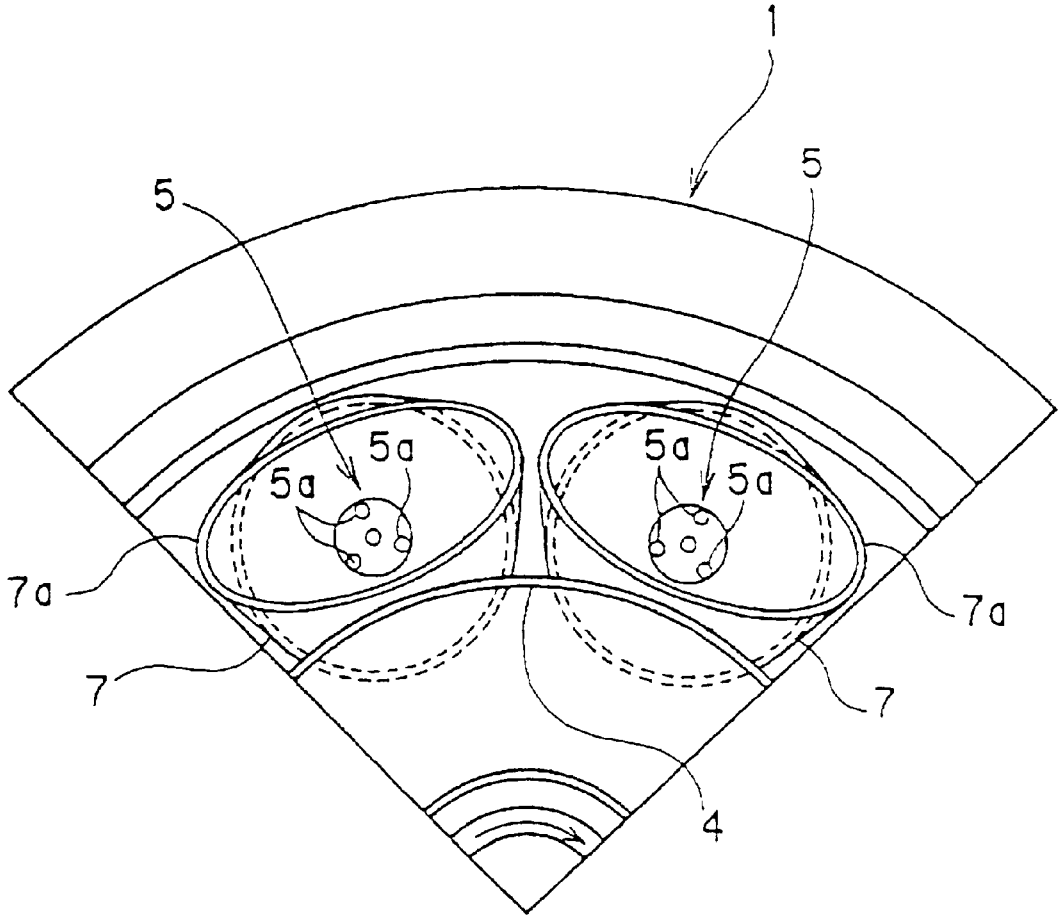
FIG. 1 is a partial front view of a gas turbine combustor showing an embodiment of the invention.
Figure 2:
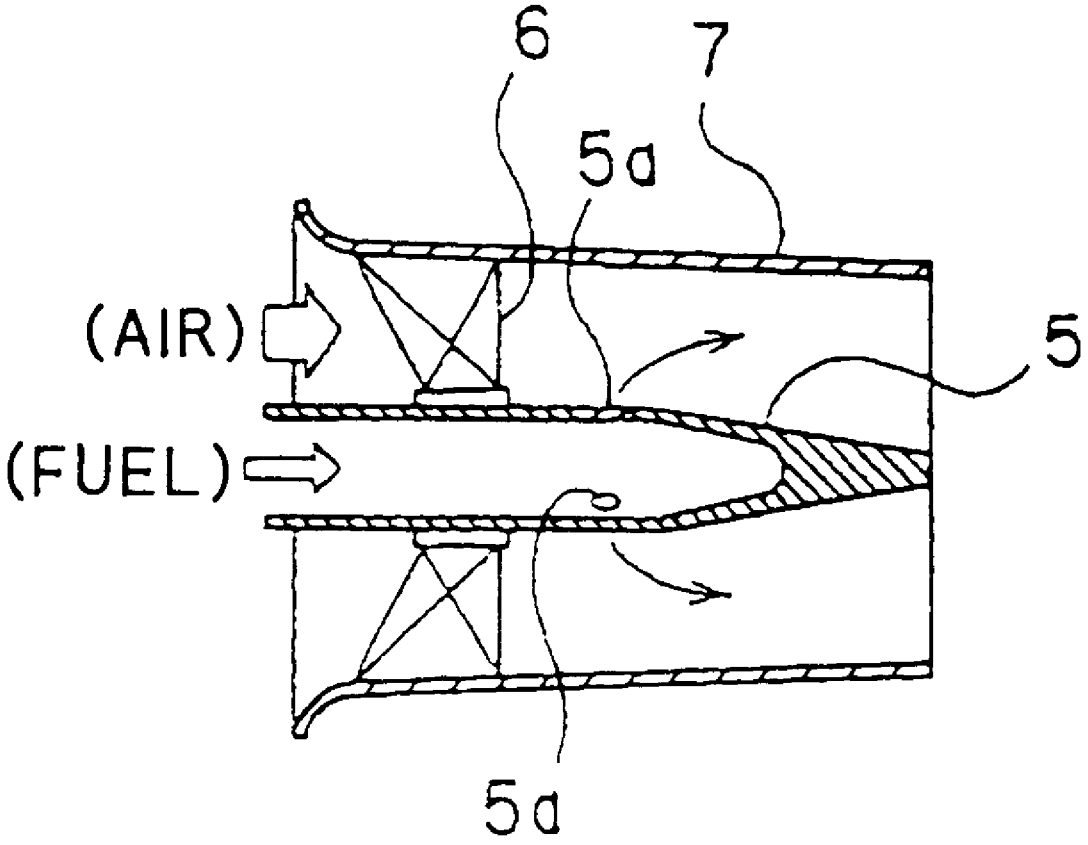
FIG. 2 is a sectional side view of a main fuel nozzle of the combustor of FIG. 1.
Figure 3:
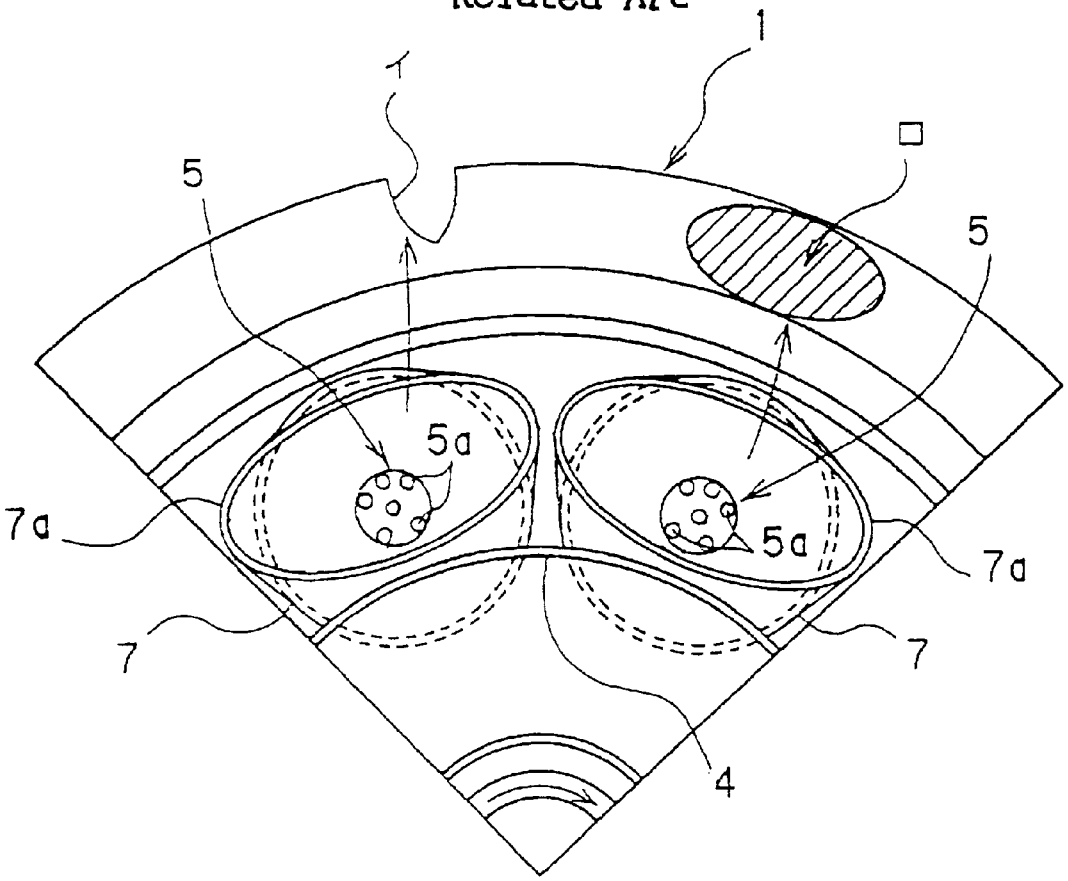
Fig.3 Related Art
FIG. 3 is a partial front view of a conventional gas turbine combustor.
Figure 5:
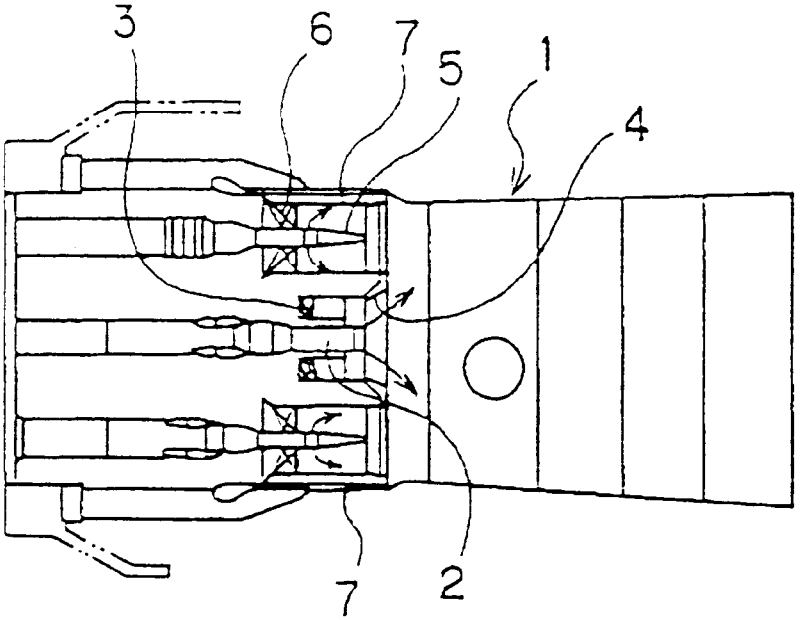
Fig.5 Related Art
FIG. 5 is a general structural view of a multi-nozzle type premixing combustor.

FIG. 1 is a partial front view of a gas turbine combustor showing an embodiment of the invention, and FIG. 2 is a sectional side view of its main fuel nozzle. The entire structure of the combustor is shown in FIG. 5, and detailed description thereof is omitted.

Figure 4:
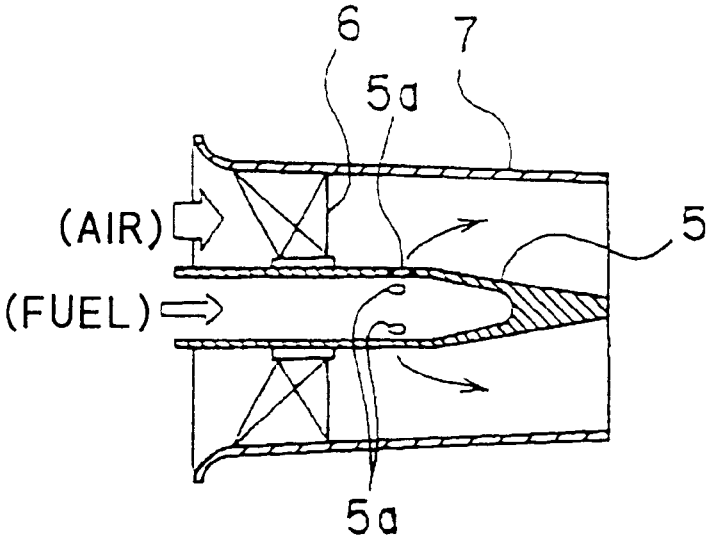
Fig.4 Related Art
FIG. 4 is a sectional side view of a main fuel nozzle of the combustor of FIG. 3.

As shown in FIG. 2, a main fuel nozzle 5 is disposed in the center of the section of a nozzle outer tube 7. A main swirler 6 is disposed in a peripheral gap between the nozzle main body outer periphery of this main fuel nozzle 5 and the inner periphery of the nozzle outer tube 7, and so far the structure is same as shown in FIG. 4.

In this embodiment, as shown in FIG. 1, in the main fuel nozzle 5, the fuel is injected from three nozzle holes 5*a* (about 1.3 mm in diameter in this embodiment) opened in the nozzle main body wall. The fuel is mixed with the air flowing around the nozzle outer periphery through the main swirler 6 so that a premixed gas is formed.

In the example shown, the three nozzle holes 5*a* are disposed at intervals of 120 degrees, and one of them is disposed at the outer side of the combustor inner tube 1 on a diametral line linking the center of the combustor inner tube 1 and the center of the main fuel nozzle 5. These nozzle holes 5*a* are opened at an inclination of about 20 degrees to the downstream side of the gas flow.

Having such configuration in the main fuel nozzle 5, one nozzle hole 5*a* is disposed at the outer side of the combustor inner tube 1, and two at the inner side, so that the fuel distribution to the outer side is decreased from that of the inner side.

Accordingly, a swirling flow of a favorably mixed premixed gas is obtained, thereby suppressing collision against the wall of the combustor inner tube 1 of the flammable premixed gas due to bouncing on the elliptical extended pipe 7*a* by the peripheral swirling flow of the main swirler 6 as experienced in the prior art.

As a result, a stable combustion state is obtained, thereby avoiding loss of combustion stability due to fuel liquid drops sticking to the wall surface of the combustor inner tube 1 which induce internal pressure fluctuations or burning of wall of the combustor inner tube 1 due to elevation of metal temperature by self-ignition.

The invention is not limited to the illustrated embodiment alone, but may be changed and modified in the number of nozzle holes, opening positions, and other ways, as long as not departing from the true spirit of the invention.

As described specifically in the embodiment, the invention according to a first aspect is a gas turbine combustor used in a gas turbine having a multi-nozzle type premixing combustor with a nozzle outer tube for forming and injecting a premixed gas of main fuel and combustion air divided and disposed in plural sections around a cone for forming a diffusion flame by reaction between pilot fuel and combustion air disposed in a center of a section of a combustor inner tube. Nozzle holes of a main fuel nozzle for injecting the main fuel are opened and formed more at the inner side than at the outer periphery of the combustor inner tube in the nozzle main body wall. The fuel distribution to the outer periphery is decreased, and therefore the fuel distribution from the main fuel nozzle is improved. Fluctuations of internal pressure and elevation of inner tube metal temperature are suppressed, and hence the combustion stability and durability of the combustor are enhanced.

Further, in the invention according to a second aspect, the nozzle holes are formed in three positions at equal intervals on the nozzle main body wall, and one of them is disposed at the outer periphery of the combustor inner tube on the diametral line linking between the center of the combustor inner tube and the center of the main fuel nozzle. Therefore the same effect and action as in the invention according to the first aspect are obtained.

What is claimed is:

1. A gas turbine combustor used in a gas turbine having a multi-nozzle type premixing combustor with a nozzle outer tube for forming and injecting a premixed gas of main fuel and combustion air divided and disposed in plural sections around a cone for forming a diffusion flame by reaction between pilot fuel and combustion air disposed in a center of a section of a combustor inner tube, wherein nozzle holes of a main fuel nozzle for injecting the main fuel are opened and formed more at the inner side than at the outer periphery of the combustor inner tube in a nozzle main body wall so that the fuel distribution to the outer periphery is decreased.

2. The gas turbine combustor according to claim 1, wherein said nozzle holes are formed in an odd number of positions at nearly equal intervals on the nozzle main body wall, and one of them is disposed at the outer periphery of the combustor inner tube on a diametral line linking between the center of the combustor inner tube and the center of the main fuel nozzle.

3. The gas turbine combustor according to claim 2, wherein said nozzle holes are formed in three positions at nearly equal intervals on the nozzle main body wall, and one of them is disposed at the outer periphery of the combustor inner tube on the diametral line linking between the center of the combustor inner tube and the center of the main fuel nozzle.

* * * * *